US006293113B1

(12) United States Patent
Prechtel

(10) Patent No.: US 6,293,113 B1
(45) Date of Patent: Sep. 25, 2001

(54) COOLING SYSTEM AND PROCESS FOR A PAPER OR CARDBOARD MACHINE

(75) Inventor: Klaus Prechtel, Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/557,404

(22) Filed: Apr. 24, 2000

(30) Foreign Application Priority Data

Apr. 30, 1999 (DE) ..... 199 19 877

(51) Int. Cl.[7] ..... F25D 1/02
(52) U.S. Cl. ..... 62/96
(58) Field of Search ..... 62/434, 96

(56) References Cited

U.S. PATENT DOCUMENTS

| | | | | |
|---|---|---|---|---|
| 4,532,777 | * | 8/1985 | Thompson | 62/434 |
| 5,105,633 | * | 4/1992 | Briggs | 62/434 |
| 5,524,442 | * | 6/1996 | Bergman, Jr. et al. | 62/86 |
| 5,961,784 | | 10/1999 | Heikkilä . | |
| 6,112,544 | * | 9/2000 | Blatter et al. | 62/434 |

FOREIGN PATENT DOCUMENTS

| | | |
|---|---|---|
| 3427624 | 2/1986 | (DE) . |
| 97/44523 | 5/1997 | (WO) . |
| 97/38161 | 10/1997 | (WO) . |

* cited by examiner

*Primary Examiner*—William Doerrler
*Assistant Examiner*—Malik N. Drake
(74) *Attorney, Agent, or Firm*—Greenblum & Bernstein, P.L.C.

(57) ABSTRACT

Cooling system and process for removing at least one of excess process heat and excess machine heat from one of a paper and cardboard machine. The cooling system includes at least one closed primary cooling cycle arranged to remove excess heat, at least one closed secondary cooling cycle arranged to remove the excess heat from the at least one closed primary cooling cycle, and at least one primary heat exchanger coupled to each at least one primary cooling cycle for transferring the excess heat from the at least one closed primary cooling cycle to the at least one closed secondary cooling cycle. The cooling device also includes a tertiary cooling water path having a cooling water feed line and a cooling water return line coupled to the one of the paper and cardboard machine, and at least one secondary heat exchanger coupled to the second cooling cycle for transferring the excess heat from the at least one closed secondary cooling cycle to the tertiary cooling water path. The process includes removing excess heat with the at least one closed primary cooling cycle, transferring the excess heat from the at least one closed primary cooling cycle to the at least one closed secondary cooling cycle via the at least one primary heat exchanger, and transferring the excess heat from the at least one closed secondary cooling cycle to the tertiary water path via the at least one secondary heat exchanger.

30 Claims, 2 Drawing Sheets

COOLING SYSTEM AND PROCESS FOR A PAPER OR CARDBOARD MACHINE

CROSS-REFERENCE TO RELATED APPLICATIONS

The present application claims priority under 35 U.S.C. § 119 of German Patent Application No. 199 19 877.2, filed on Apr. 30, 1999, the disclosure of which is expressly incorporated by reference herein in its entirety.

BACKGROUND OF THE INVENTION

1. Field of the Invention

The present invention relates to a cooling system for removing excess process heat and/or machine heat from a paper or cardboard machine.

2. Discussion of Background Information

A device similar in general to the one discussed above is known from International Publication No. WO 97/44523, in which a cooling system of a paper mill uses a cooling tower to reduce the use of cooling water. The cooling tower, in addition to the fresh water flowing through it, takes over a substantial share of the heat removal in the paper mill.

However, one problem of the above-noted device is that, when using such cooling systems in a paper machine, the coolant liquids provided for the cooling function in the machine are usually oily, oil-containing, or other liquids with a high boiling point which may, to an extent, also serve lubrication purposes or are at least intended to protect against corrosion. Generally, these coolant liquids can be harmful to the environment and can also be detrimental to the paper manufacturing process if they reach the process cycle of the paper machine.

SUMMARY OF THE INVENTION

The present invention provides an improved cooling system which offers increased protection against contamination of the process water of a paper or cardboard machine as well as of the waste water that leaves the facility.

According to the invention, a cooling system is provided for removing excess process heat and/or machine heat from a paper or cardboard machine. The cooling system includes at least one closed primary cooling cycle (primary cycle) which removes the excess heat, and each primary cycle has at least one primary fluid/water heat exchanger for transferring the heat to at least one closed secondary cooling cycle (secondary cycle). Each at least one closed secondary cooling cycle includes at least one secondary water/water heat exchanger for transferring the heat of the secondary cycle to a tertiary cooling water path of the paper or cardboard machine. The tertiary cooling water path of the paper or cardboard machine includes a tertiary water/water heat exchanger, as well as a cooling water inlet and a cooling water outlet to and from the tertiary water/water heat exchanger.

An exemplary embodiment of the cooling system according to the invention ensures that, even in the case of leakage of the primary heat exchanger, the cooling fluid (e.g., oil) originating from the primary cycle cannot get into the process water or the waste water. In this manner, an interruption of production due to impurities in the process water or damage to the environment by waste water that is contaminated or polluted with chemicals can be effectively prevented.

An advantageous feature of the cooling system according to the invention provides for the tertiary cooling water path to be a component of a tertiary cooling water cycle (tertiary cycle) and to have a cooling tower that releases the excess heat into the ambient air. Besides providing ecologically advantageous protection against contamination of the environment, this measure also reduces the use of fresh water and, thus, achieves a lower use of natural resources.

In a further embodiment of the cooling system, the tertiary cooling water cycle has a cooling water collection tank through which the cooling water is supplied to the cooling tower and, optionally, can be supplied to the production process. Additionally or alternatively, the tertiary cooling cycle can be provided with an intermediate tank for the cooling water between the cooling tower and the secondary heat exchanger. Naturally, individual units such as the heat exchanger, the tank, and the cooling tower can be interconnected by conduits for transporting the cooling fluid and, optionally, have corresponding feed devices.

These hydraulic buffers, which can be formed as unpressurized, open tanks, can be used to intercept operational fluctuations in the cooling cycle in a simple manner.

Moreover, it is noted that the features of the instant invention can be utilized, not only in the combinations shown in the exemplary embodiments, but also in other combinations or by themselves without departing from the spirit and scope of the invention.

The present invention is directed to a cooling system for removing at least one of excess process heat and excess machine heat from one of a paper and cardboard machine. The cooling system includes at least one closed primary cooling cycle arranged to remove excess heat, at least one closed secondary cooling cycle arranged to remove the excess heat from the at least one closed primary cooling cycle, and at least one primary heat exchanger coupled to each at least one primary cooling cycle for transferring the excess heat from the at least one closed primary cooling cycle to the at least one closed secondary cooling cycle. The cooling device also includes a tertiary cooling water path having a cooling water feed line and a cooling water return line coupled to the one of the paper and cardboard machine, and at least one secondary heat exchanger coupled to the second cooling cycle for transferring the excess heat from the at least one closed secondary cooling cycle to the tertiary cooling water path.

According to a feature of the instant invention, the at least one primary heat exchanger can be arranged within each of the at least one closed primary cooling cycle, and the at least one secondary heat exchanger can be arranged within the at least one closed secondary cooling cycle.

In accordance with another feature of the invention, the primary heat exchanger can include a fluid/water heat exchanger, and the fluid/water heat exchanger can include oil.

According to a further aspect of the invention, the secondary heat exchanger can include a water/water heat exchanger.

In accordance with still another aspect of the present invention, the at least one closed primary cycle can include oil as a heat carrier Further, a tertiary cooling water cycle can include the tertiary cooling water path and a cooling tower. The cooling tower may be adapted to transfer the excess heat from the tertiary cooling water path to ambient air. The cooling tower can include a fan for transferring the excess heat into the ambient air. The tertiary cooling water cycle can also include a cooling water collection tank coupled to the cooling tower, and the cooling water collection tank can be arranged to supply cooling water to the cooling tower. The cooling water collection tank may be arranged to supply cooling water to a manufacturing process in the one of the paper and cardboard machine. Further, the tertiary cooling water cycle can also include all intermediate tank positioned between the cooling tower and the secondary heat exchanger, in which the intermediate tank includes an inlet for fresh water.

According to still another feature of the present invention, the at least one closed primary cooling cycle can be arranged to cool machine components. The machine components can include at least one of bearings and press rolls.

The instant invention is directed to a process of cooling one of a paper and cardboard machine with an apparatus that includes at least one closed primary cooling cycle, at least one closed secondary cooling cycle, at least one primary heat exchanger coupled to each at least one primary cooling cycle, a tertiary cooling water path comprising a cooling water feed line and a cooling water return line coupled to the one of the paper and cardboard machine, and at least one secondary heat exchanger coupled to the second cooling cycle. The process includes removing excess heat with the at least one closed primary cooling cycle, transferring the excess heat from the at least one closed primary cooling cycle to the at least one closed secondary cooling cycle via the at least one primary heat exchanger, and transferring the excess heat from the at least one closed secondary cooling cycle to the tertiary water path via the at least one secondary heat exchanger.

According to an aspect of the instant invention, the at least one primary heat exchanger can include a fluid/water heat exchanger, and the at least one secondary heat exchanger can include a water/water heat exchanger.

In accordance with another aspect of the invention, the fluid/water heat exchanger can include oil as a heat carrier.

Moreover, the apparatus can include a tertiary cooling water cycle that includes the tertiary cooling water path and a cooling tower, and the process can further include transferring the excess heat from the tertiary cooling water path to ambient air via the cooling tower. Further, the tertiary cooling water cycle can include a cooling water collection tank coupled to the cooling tower, and the process may include supplying cooling water from the cooling water collection tank to the cooling tower. Still further, the process may include supplying cooling water from the cooling water collection to a manufacturing process in the one of the paper and cardboard machine. Still further, the tertiary cooling water cycle can include an intermediate tank positioned between the cooling tower and the secondary heat exchanger, and the process may include supplying fresh water to the intermediate tank.

The present invention can be directed to a cooling system for removing at least one of excess process heat and excess machine heat from one of a paper and cardboard machine. The cooling system includes at least one closed primary cooling cycle which removes excess heat, at least one closed secondary cooling cycle arranged to remove the excess heat from the at least one closed primary cooling cycle, and at least one primary heat exchanger coupled to each at least one primary cooling cycle for transferring the excess beat from the at least one closed primary cooling cycle to the at least one closed secondary cooling cycle. The cooling system also includes a tertiary cooling water cycle comprising a cooling water feed line and a cooling water return line coupled to the one of the paper and cardboard machine, and a water tower, and at least one secondary heat exchanger coupled to the second cooling cycle for transferring the excess heat from the at least one closed secondary cooling cycle to the tertiary cooling water cycle.

In accordance with an aspect of present invention, the tertiary cooling water cycle can further include a cooling water collection tank coupled to the cooling tower and an intermediate tank positioned between the cooling tower and the secondary heat exchanger. The cooling water collection tank can be arranged to supply cooling water to the cooling tower, and the intermediate tank can be positioned to supply cooling water to the cooling water feed line. The cooling water collection tank may be arranged to supply cooling water to a manufacturing process in the one of the paper and cardboard machine, and the intermediate tank can include a fresh water inlet to receive fresh water, According to yet another feature of the instant invention, the at least one primary heat exchanger can be arranged within each of the at least one closed primary cooling cycle and the at least one secondary heat exchanger can be arranged within the at least one closed secondary cooling cycle. The primary heat exchanger can include a fluid/water heat exchanger, and the secondary heat exchanger can include a water/water heat exchanger. The fluid/water heat exchanger can include oil.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
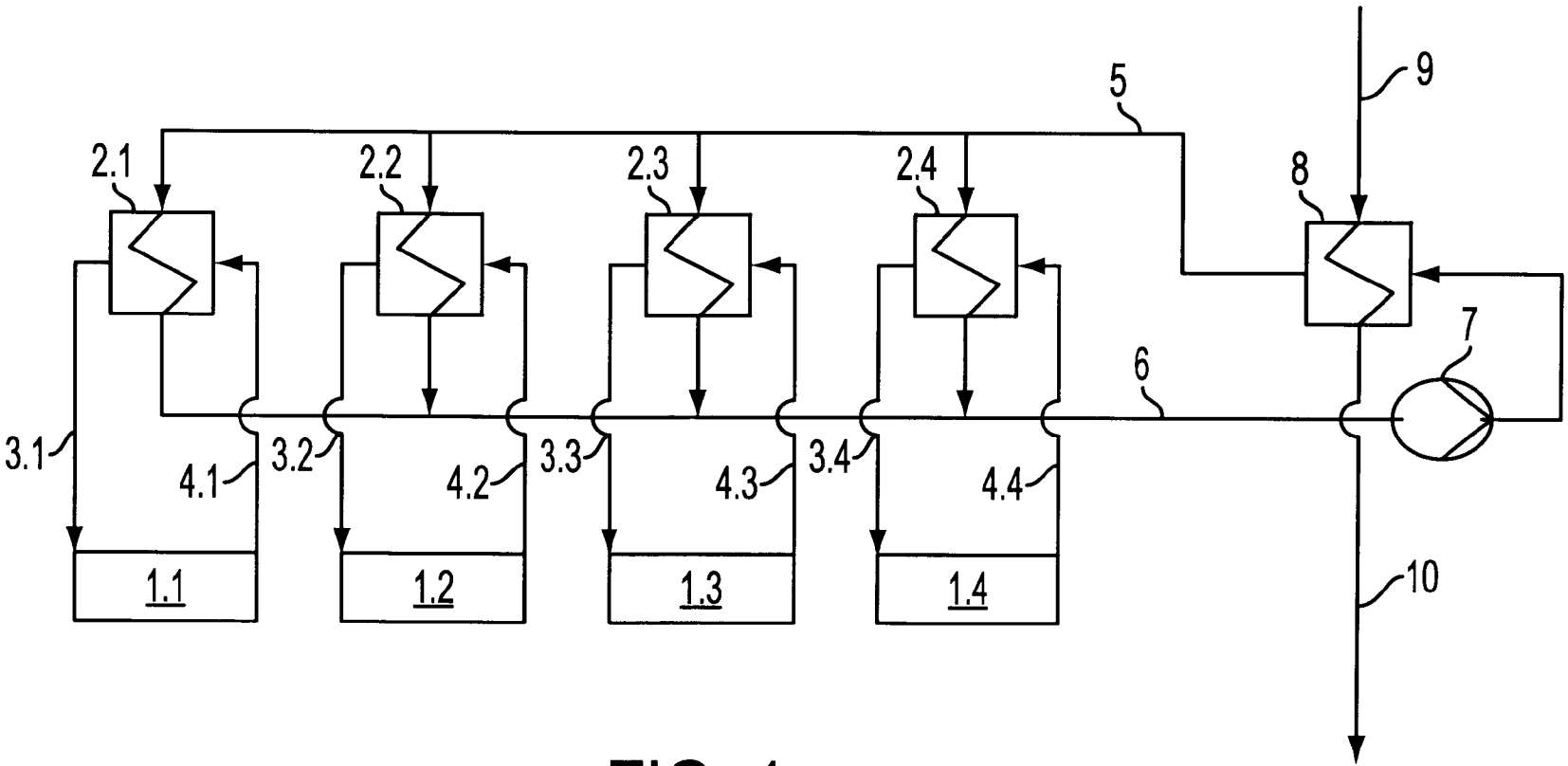
FIG. 1 illustrates a two-cycle cooling system in accordance with the features of the instant invention.

FIG. 1 illustrates a cooling system according to the present invention for a paper machine with, e.g., four primary cycles arranged parallel to one another. Each primary cycle can include a feed line 3.1, 3.2, 3.3, and 3.4 and a return line 4.1, 4.2, 4.3, and 4.4, which are arranged to cool devices 1.1, 1.2, 1.3, and 1.4 (e.g., bearings, press rolls, other machine components, etc.) with the aid of a circulating fluid, e.g., oil.

Primary heat exchangers 2.1, 2.2, 2.3, and 2.4, e.g., fluid/water heat exchangers, are arranged in each primary cycle, i.e., between feed lines 3.1, 3.2, 3.3, and 3.4 and return lines 4.1, 4.2, 4.3, and 4.4. With the aid of primary heat exchangers 2.1, 2.2, 2.3, and 2.4, the waste heat can be transferred to a secondary cooling cycle, which includes a feed line 5 and a return line 6. Relative to the secondary cooling cycle, the primary cooling cycles form closed cycles which have indirect points of contact only in the regions of primary heat exchangers 2.1, 2,2, 2.3, and 2.4. In the secondary cooling cycle, feed line 5 and return line 6 are arranged to "connect" primary beat exchangers 2.1, 2.2, 2.3, and 2.4 "parallel" to one another. Return line 6 can be coupled to a feeder pump 7 which feeds the heated water from the secondary cooling cycle to a secondary heat exchanger 8, e.g., a water/water heat exchanger.

In secondary heat exchanger 8, the heated water is cooled via a tertiary cooling water path that includes a feed line 9 and a return line 10. Further, the secondary cooling cycle is also closed relative to the tertiary cooling water path.

In accordance with this exemplary embodiment of the cooling cycle, it can be ensured that, even with the occurrence of leaks within any of primary heat exchangers 2.1, 2.2, 2.3, and 2.4, pollutants from the primary cycles can, at most, penetrate the secondary cycle. However, because the secondary cooling cycle partitions the tertiary cooling water path from the primary cooling cycle, the pollutants cannot reach the tertiary cooling water path. Therefore, the tertiary cooling water path can be connected to the outside world, e.g., as process water or waste water, as well as to other portions of the paper or cardboard machine, if desired, through secondary heat exchanger 8. In the case of a leak, the cleaning of the secondary cooling cycle is possible in a relatively simple and cost-effective manner, and costly damage to the environment or interruptions in production because of contaminated process or waste water (which runs through the tertiary cooling water path) can be prevented.

Figure 2:
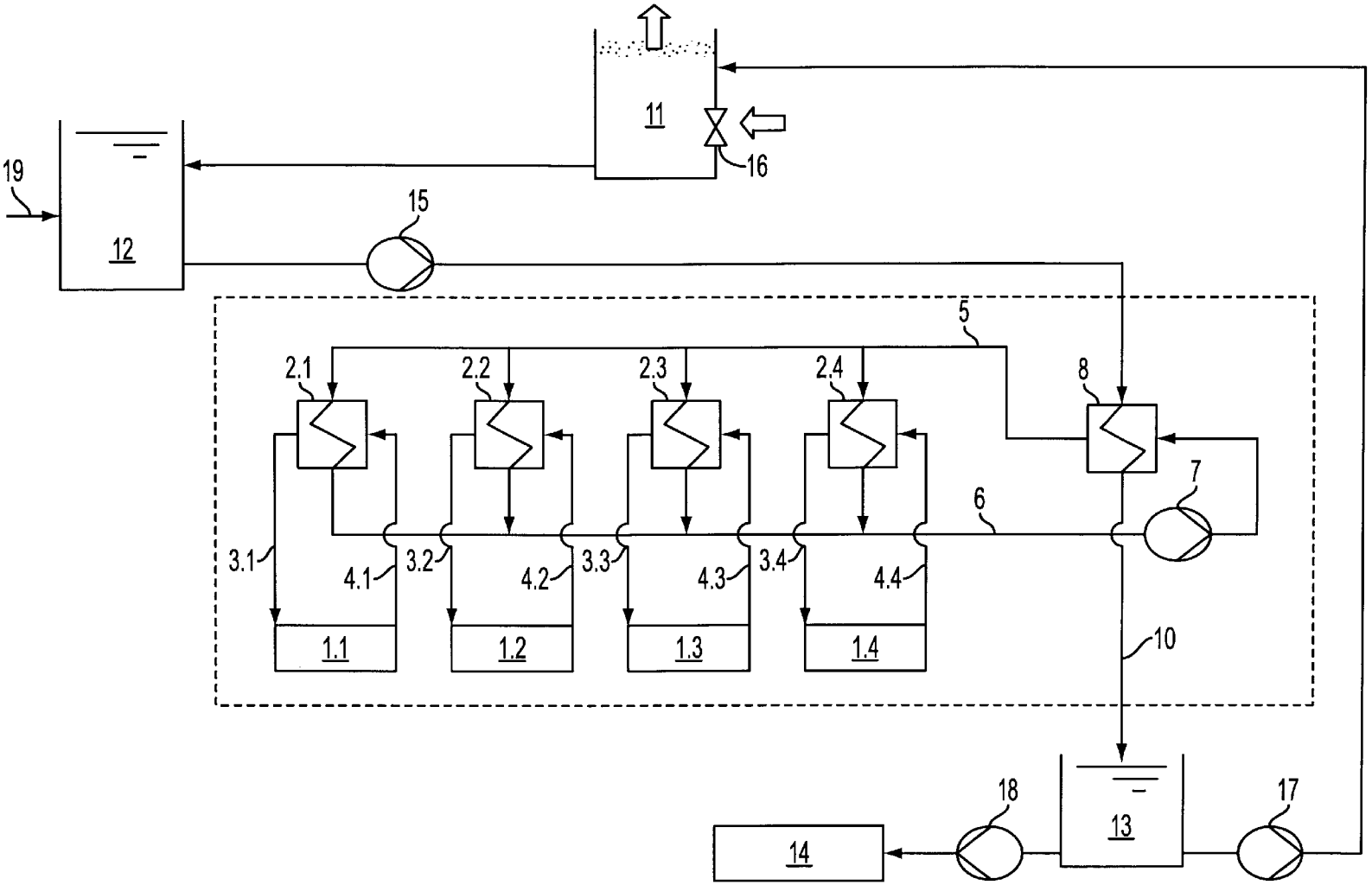
FIG. 2 illustrates the two-cycle cooling system depicted in FIG. 1 along with additional elements, including a cooling tower.

Another exemplary embodiment of the cooling system according to the invention is shown in FIG. 2. It is noted that the portion of the system surrounded by dotted lines corresponds to the cooling cycle depicted in FIG. 1. Additionally, it is noted that this embodiment includes a cooling tower 11, which is arranged to receive, from return line 10, the heated cooling water from secondary heat exchanger 8, and to supply the cooling water to feed line 9. In this manner, a tertiary cooling cycle can be formed.

In cooling tower 11, the heated water from return line 10 is cooled with the aid of ambient air which passes therethrough. To support such a stream of cool air, cooling tower 11 can include a fan 16. In this manner, the amount of fresh water required can be considerably reduced because the cooling is supported by the ambient air. Thus, only an amount of fresh water necessary for fresh process water is required, which can then be taken from the tertiary cooling cycle.

For problem-free regulation of the tertiary cycle, an intermediate tank 12 is arranged subsequent to the cooling tower (i.e., in the water flow direction). A fresh water conduit 19 can be coupled to intermediate tank 12 to optionally provide fresh water into intermediate tank 12. Further a cooling water collection tank 13 can be arranged between secondary heat exchanger 8 and cooling tower 11 such that process water needed in manufacturing process 14 can be removed from cooling water collection tank 13 via a supply pump 18 and supplied to the necessary manufacturing process 14. The supply of the cooling water from cooling water collection tank 13 to cooling tower 11 can be performed by a supply pump 17.

Overall, the cooling system according to the invention achieves substantially greater protection against contamination of the process water of a paper or cardboard machine and of the waste water discharged therefrom.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST REFERENCE CHARACTERS

1.1–1.4 Devices to be cooled
2.1–2.4 Primary fluid/water heat exchanger
3.1–3.4 Primary cooling water feed line
4.1–4.4 Primary cooling water return line
5 Secondary cooling water feed line
6 Secondary cooling water return line
7 Supply pump
8 Secondary water/water heat exchanger
9 Tertiary feed line
10 Tertiary return line
11 Cooling tower
12 Intermediate tank
13 Cooling water collection tank
14 Paper production process
15 Supply pump
16 Fan
17 Supply pump
18 Supply pump
19 Fresh water supply

What is claimed:

1. A cooling system for removing at least one of excess process heat and excess machine heat from one of a paper and cardboard machine, the cooling system comprising:

at least one closed primary cooling cycle arranged to remove excess heat;

at least one closed secondary cooling cycle arranged to remove the excess heat from the at least one closed primary cooling cycle;

at least one primary heat exchanger coupled to each at least one primary cooling cycle for transferring the excess heat from said at least one closed primary cooling cycle to said at least one closed secondary cooling cycle;

a tertiary cooling water path comprising a cooling water feed line and a cooling water return line coupled to the one of the paper and cardboard machine; and at least one secondary heat exchanger coupled to said secondary cooling cycle for transferring the excess heat from said at least one closed secondary cooling cycle to said tertiary cooling water path.

2. The cooling system in accordance with claim 1, wherein said at least one primary heat exchanger is arranged within each of said at least one closed primary cooling cycle; and wherein said at least one secondary heat exchanger is arranged within said at least one closed secondary cooling cycle.

3. The cooling system in accordance with claim 1, wherein said primary heat exchanger comprises a fluid/water heat exchanger.

4. The cooling system in accordance with claim 3, wherein said fluid/water heat exchanger includes oil.

5. The cooling system in accordance with claim 1, wherein said secondary heat exchanger comprises a water/water heat exchanger.

6. The cooling system in accordance with claim 1, wherein said at least one closed primary cycle comprises oil as a heat carrier.

7. The cooling system in accordance with claim 1, further comprising a tertiary cooling water cycle comprising said tertiary cooling water path and a cooling tower.

8. The cooling system in accordance with claim 7, wherein said cooling tower is adapted to transfer the excess heat from said tertiary cooling water path to ambient air.

9. The cooling system in accordance with claim 8, wherein said cooling tower comprises a fan for transferring the excess heat into the ambient air.

10. The cooling system in accordance with claim 8, wherein said tertiary cooling water cycle further comprises a cooling water collection tank coupled to said cooling tower.

11. The cooling system in accordance with claim 10, wherein said cooling water collection tank is arranged to supply cooling water to said cooling tower.

12. The cooling system in accordance with claim 11, wherein said cooling water collection tank is arranged to supply cooling water to a manufacturing process in the one of the paper and cardboard machine.

13. The cooling system in accordance with claim 7, wherein said tertiary cooling water cycle further comprises an intermediate tank positioned between said cooling tower and said secondary heat exchanger.

14. The cooling system in accordance with claim 13, wherein said intermediate tank comprises an inlet for fresh water.

15. The cooling system in accordance with claim 1, wherein said at least one closed primary cooling cycle is arranged to cool machine components.

16. The cooling system in accordance with claim 15, wherein said machine components comprise at least one of bearings and press rolls.

17. A process of cooling one of a paper and cardboard machine with an apparatus that includes at least one closed primary cooling cycle, at least one closed secondary cooling cycle, at least one primary heat exchanger coupled to each at least one primary cooling cycle, a tertiary cooling water path comprising a cooling water feed line and a cooling water return line coupled to the one of the paper and cardboard machine, and at least one secondary heat exchanger coupled to the second cooling cycle, the process comprising:

removing excess heat with the at least one closed primary cooling cycle;

transferring the excess heat from the at least one closed primary cooling cycle to the at least one closed secondary cooling cycle via the at least one primary heat exchanger; and transferring the excess heat from the at least one closed secondary cooling cycle to the tertiary water path via the at least one secondary heat exchanger.

18. The process in accordance with claim 17, wherein the at least one primary heat exchanger comprises a fluid/water heat exchanger, and wherein the at least one secondary heat exchanger comprises a water/water heat exchanger.

19. The process in accordance with claim 17, wherein the fluid/water heat exchanger includes oil as a heat carrier.

20. The process in accordance with claim 17, wherein the apparatus further includes a tertiary cooling water cycle that includes the tertiary cooling water path and a cooling tower, and the process further comprises:

transferring the excess heat from the tertiary cooling water path to ambient air via the cooling tower.

21. The process in accordance with claim 20, wherein the tertiary cooling water cycle further includes a cooling water collection tank coupled to the cooling tower, and the process further comprises supplying cooling water from the cooling water collection tank to the cooling tower.

22. The process in accordance with claim 21, wherein the process further comprises supplying cooling water from the cooling water collection to a manufacturing process in the one of the paper and cardboard machine.

23. The process in accordance with claim 20, wherein the tertiary cooling water cycle further includes an intermediate tank positioned between the cooling tower and the secondary heat exchanger, and the process further comprises supplying fresh water to the intermediate tank.

24. A cooling system for removing at least one of excess process heat and excess machine heat from one of a paper and cardboard machine, the cooling system comprising:

at least one closed primary cooling cycle which removes excess heat;

at least one closed secondary cooling cycle arranged to remove the excess heat from the at least one closed primary cooling cycle;

at least one primary heat exchanger coupled to each at least one primary cooling cycle for transferring the excess heat from said at least one closed primary cooling cycle to said at least one closed secondary cooling cycle;

a tertiary cooling water cycle comprising a cooling water feed line and a cooling water return line coupled to the one of the paper and cardboard machine, and a water tower; and at least one secondary heat exchanger coupled to said second cooling cycle for transferring the excess heat from said at least one closed secondary cooling cycle to said tertiary cooling water cycle.

25. The cooling system in accordance with claim 24, wherein said tertiary cooling water cycle further comprises:

a cooling water collection tank coupled to said cooling tower; and an intermediate tank positioned between said cooling tower and said secondary heat exchanger.

26. The cooling system in accordance with claim 25, wherein said cooling water collection tank is arranged to supply cooling water to said cooling tower, and wherein said intermediate tank is positioned to supply cooling water to said cooling water feed line.

27. The cooling system in accordance with claim 26, wherein said cooling water collection tank is arranged to supply cooling water to a manufacturing process in the one of the paper and cardboard machine, and wherein said intermediate tank comprises a fresh water inlet to receive fresh water.

28. The cooling system in accordance with claim 24, wherein said at least one primary heat exchanger is arranged within each of said at least one closed primary cooling cycle; and wherein said at least one secondary heat exchanger is arranged within said at least one closed secondary cooling cycle.

29. The cooling system in accordance with claim 28, wherein said primary heat exchanger comprises a fluid/water heat exchanger, and wherein said secondary heat exchanger comprises a water/water heat exchanger.

30. The cooling system in accordance with claim 29, wherein said fluid/water heat exchanger includes oil.

* * * * *